US009761393B2

(12) United States Patent
Claus et al.

(10) Patent No.: US 9,761,393 B2
(45) Date of Patent: Sep. 12, 2017

(54) METHOD FOR PRODUCTION OF A POLE PART OF A MEDIUM-VOLTAGE SWITCHING DEVICE, AS WELL AS THE POLE PART ITSELF

(75) Inventors: Oliver Claus, Ratingen (DE); Dietmar Gentsch, Ratingen (DE); Christof Humpert, Willich (DE)

(73) Assignee: ABB Schweiz AG, Baden (CH)

( * ) Notice: Subject to any disclaimer, the term of this patent is extended or adjusted under 35 U.S.C. 154(b) by 684 days.

(21) Appl. No.: 12/717,646

(22) Filed: Mar. 4, 2010

(65) Prior Publication Data

US 2010/0206848 A1 Aug. 19, 2010

Related U.S. Application Data

(63) Continuation of application No. PCT/EP2008/007120, filed on Sep. 1, 2008.

(30) Foreign Application Priority Data

Sep. 5, 2007 (EP) ..... 07017361

(51) Int. Cl.
*H01H 33/662* (2006.01)

(52) U.S. Cl.
CPC ..... *H01H 33/66207* (2013.01); *H01H 2033/6623* (2013.01)

(58) Field of Classification Search
CPC ..... H01H 33/662; H01H 33/66207; H01H 2033/6623
USPC .... 218/10, 42, 118–122, 134–140, 153–155; 29/622
See application file for complete search history.

(56) References Cited

U.S. PATENT DOCUMENTS

| | | | | |
|---|---|---|---|---|
| 7,304,262 | B2 * | 12/2007 | Stoving et al. | 218/120 |
| 2005/0016963 | A1 * | 1/2005 | Stoving et al. | 218/120 |
| 2008/0142485 | A1 | 6/2008 | Gentsch et al. | |
| 2009/0218318 | A1 | 9/2009 | Gentsch | |

FOREIGN PATENT DOCUMENTS

| | | | |
|---|---|---|---|
| AU | 706795 | B3 | 6/1999 |
| DE | 199 06 972 | A1 | 8/2000 |
| DE | 10 2005 039 555 | A1 | 3/2007 |
| DE | 10 2006 041 149 | A1 | 3/2008 |
| EP | 0 866 481 | A2 | 9/1998 |

OTHER PUBLICATIONS

Translation of DE 19906972A1 Aug. 2000 Dullni et al. pp. 1 and 2.*

(Continued)

*Primary Examiner* — Amy Cohen Johnson
(74) *Attorney, Agent, or Firm* — Taft Stettinius & Hollister LLP

(57) ABSTRACT

A method for production of a pole part of a medium-voltage switching device, and a pole part are provided. To obviate costly pressure reinforcements at least on the switching contact side of the vacuum interrupt chamber in the area of the mold core, while also achieving an optimum injection-molded result, a compensation ring is positioned, before the encapsulation process, as a separate injection-molded seal on or close to the external circumferential line of a vacuum interrupt chamber cover, between the lower cover of the vacuum interrupt chamber and the mold core. The positioned compensation ring is also encapsulated so as to remain in the encapsulation, and the mold core is then removed.

17 Claims, 2 Drawing Sheets

(56) References Cited

OTHER PUBLICATIONS

International Search Report of Application No. PCT/EP2008/007120 dated Dec. 3, 2008.
European Search Report of Application No. 07017361.2 dated Nov. 12, 2007.
International Preliminary Report on Patentability (Form PCT/IB/373) issued in PCT/EP2008/007120, Mar. 9, 2010, and accompanying Written Opinion (Form PCT/ISA/237); European Patent Office, Munich, DE.

* cited by examiner

METHOD FOR PRODUCTION OF A POLE PART OF A MEDIUM-VOLTAGE SWITCHING DEVICE, AS WELL AS THE POLE PART ITSELF

RELATED APPLICATIONS

This application claims priority as a continuation application under 35 U.S.C. §120 to PCT/EP2008/007120, which was filed as an International Application on Sep. 1, 2008 designating the U.S., and which claims priority to European Application 07017361.2 filed in Europe on Sep. 5, 2007. The entire contents of these applications are hereby incorporated by reference in their entireties.

FIELD

The present disclosure relates to a method of producing a pole part of a medium-voltage switching device, and to such a pole part.

BACKGROUND INFORMATION

Medium-voltage switching devices are equipped with so-called pole parts in which vacuum interrupt chambers, which are the actual switching elements, are installed, or are encapsulated in the situation that is relevant to the present disclosure. Pole parts have two fixed-position connecting pieces, by means of which the switching device is connected to further components in the switchgear assembly. The fixed-position connecting pieces are connected to the supply lines to the vacuum interrupt chamber, within the pole part. On one side, i.e., the fixed contact side, the connection is rigid, and is produced before the encapsulation of the pole part. On the other side, i.e., the switching contact side, the fixed-position connecting piece of the pole part is connected to the moving supply line of the vacuum interrupt chamber so as to allow relative movement of the moving supply line. This latter connection may be produced in the form of a multicontact system before encapsulation, or else in the form of a current ribbon after encapsulation.

It is known for encapsulated pole parts to be produced from epoxy resin using a pressure gelation process. The epoxy-resin pole part is used to increase the external dielectric strength of the vacuum interrupt chamber, and carries out mechanical functions. It is likewise known for pole parts to be produced using an injection-molding process, in which case thermoplastics can be used, in addition to thermosetting plastic materials, as is known from DE 10 2005 039 555 A1.

In contrast to the pressure gelation process, mold internal pressures occur in the injection-molding process and are more than 100 bar, for example, approximately 300-400 bar is of mold internal pressures are known to occur for conventional injection molding.

The injection-molding process involves a considerably reduced cycle time and a simplified production process, and ensures the mechanical and dielectric characteristics.

In all of the already known methods for production of encapsulated pole parts, the vacuum interrupt chamber is encapsulated completely in the insulating material, except for the end surface on the switching contact side. The free space which is required for the switching function below the vacuum interrupt chamber is achieved by means of a so-called mold core, which is sealed on the end surface of the cover of the vacuum interrupt chamber, and which prevents the ingress of liquid insulating material during the encapsulation process.

During the spraying process in injection molding, forces act on the vacuum interrupt chamber. Locally, such forces first of all affect the tool internal pressure that occurs, and can lead to local deformation of the steel covers of the vacuum interrupt chambers. However, the filling process also results in overall forces on the vacuum interrupt chamber. In the case of filling from the fixed-contact side, an axial force acts on the vacuum interrupt chamber, which can lead to the upper and lower chamber covers being forced inward when a fixed mold core is used.

In an attempt to ensure that the vacuum interrupt chamber will withstand these forces without being damaged, it has been proposed for the vacuum interrupt chamber to be reinforced by wall-thickness inserts in the stainless-steel covers, by external caps or by specifically shaped ceramic parts (application No. 102006041149.8-34).

The proposed reinforcement measures for the vacuum interrupt chamber, however, involve processes with high costs.

SUMMARY

An exemplary method is provided for production of a pole part of a medium-voltage switching device, in which a vacuum interrupt chamber is provided with an insulating encapsulation by which the vacuum interrupt chamber is encapsulated together with a mold core, which is fitted to the vacuum interrupt chamber on a lower cover of the vacuum interrupt chamber, in a casting mold using an insulating material. The exemplary method comprises, before the encapsulation process, positioning a compensation ring as a separate injection-molded seal on or close to an external circumferential line of a vacuum interrupt chamber cover of the vacuum interrupt chamber, between the lower cover of the vacuum interrupt chamber and the mold core. The exemplary method also comprises encapsulating the vacuum interrupt chamber so that the positioned compensation ring remains in the encapsulation, and removing the mold core.

An exemplary embodiment provides a pole part for a medium-voltage switching device, in which a vacuum interrupt chamber is provided with insulation encapsulation. The exemplary pole part comprises a compensation ring arranged for temporary contact with an injection-mold core on a cover face of the vacuum interrupt chamber to which the injection-mold core is temporarily applied for the encapsulation process. The compensation link is arranged to remain in the complete encapsulation.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Exemplary embodiments of the present disclosure obviate costly pressure reinforcements at least on the switching contact side of the vacuum interrupt chamber in the area of the mold core, and also achieve an optimum injection-molded result.

According to an exemplary method for producing a pole part, before the encapsulation process, a compensation ring is positioned as a separate injection-molded seal on or close to the external circumferential line of the vacuum interrupt chamber cover in the region of the cylindrically designed ceramic on the end surface, between the lower cover of the vacuum interrupt chamber. The mold core is then also encapsulated such that it remains as a lost seal in the encapsulation. The mold core is then removed again. According to an exemplary embodiment, the compensation ring reduces the load on the vacuum interrupt chamber during the injection-molding process.

According to an exemplary embodiment, the mold core that is used in the production process can be composed of hardened steel, for example. According to this exemplary embodiment, the use of the compensation ring achieves the desired load reduction, such as when using the ring between ceramic and the steel core, for example.

According to an exemplary embodiment, the compensation ring which is used as the injection-molded seal in the production process can be composed of copper or a copper alloy, for example. A suitable softer material is thus chosen.

According to another exemplary embodiment, the compensation ring which is used as the injection-molded seal in the production process can be composed of aluminum or an aluminum alloy, for example.

According to another exemplary embodiment, the compensation ring which is used as the injection-molded seal in the production process can be composed of temperature-resistant and pressure-resistant plastic, which withstands known injection-molding temperatures during the known injection-molding pressures.

Figure 1:
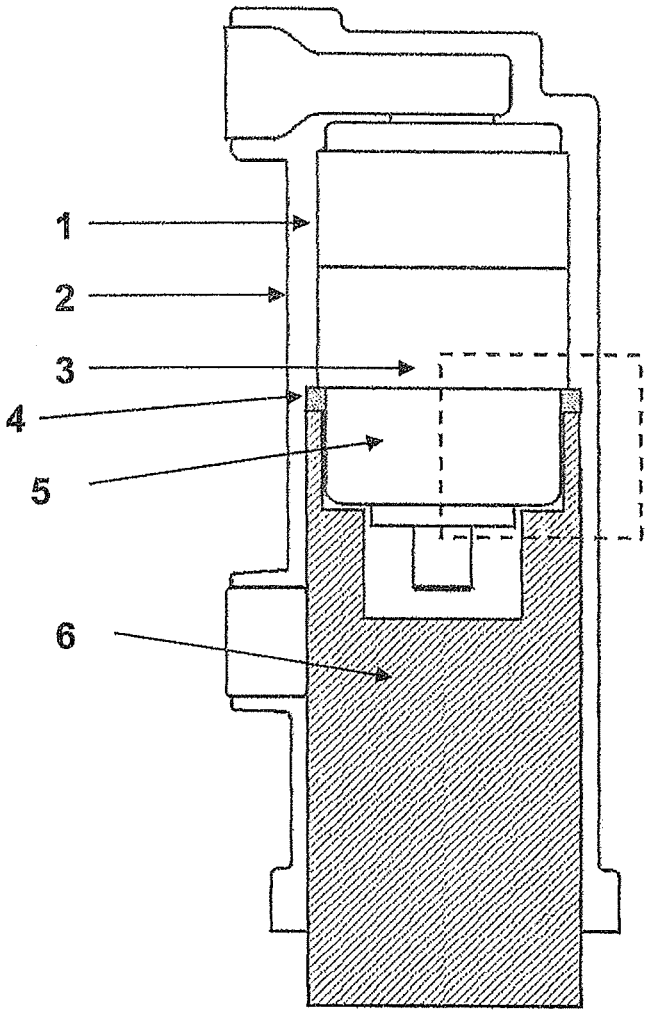
FIG. 1 shows an exemplary pole part with a mold part inserted, and a compensation ring according to at least one embodiment of the present disclosure.
Figure 2:
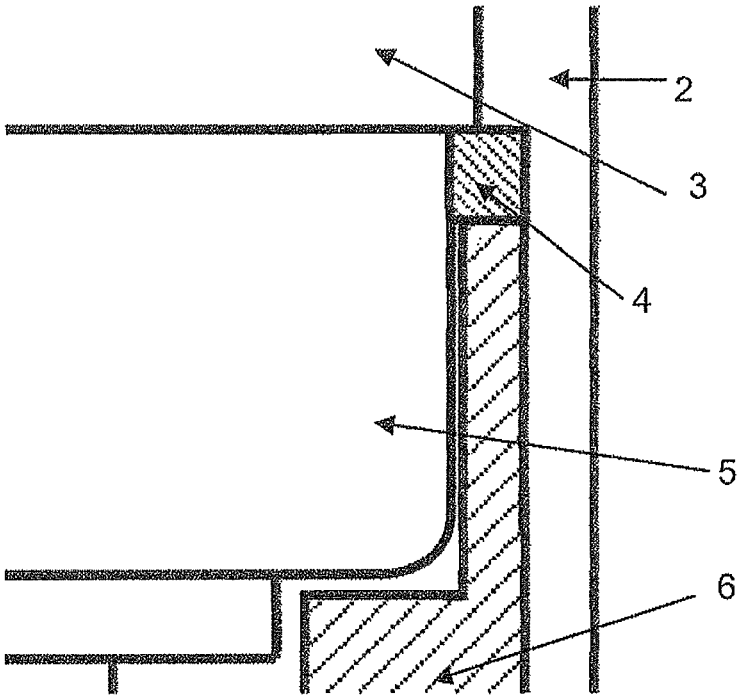
FIG. 2 shows an enlarged perspective view of an exemplary features of the embodiment illustrated in FIG. 1.

An exemplary embodiment of the present disclosure is illustrated in FIGS. 1 and 2, where FIG. 2 illustrates constituent elements within the dotted line box of FIG. 1 in more detail. According to the exemplary embodiment illustrated in FIGS. 1 and 2, a compensation ring 4 can be inserted, before the encapsulation process, between the mold core 6 and the ceramic insulator (end surface) 3 of the vacuum interrupt chamber 1. The compensation ring 4 acts as a mold seal in the insert part (the vacuum interrupt chamber 1) and dissipates the axial forces exerted on the vacuum interrupt chamber 1 via the ceramic 3 to the mold core 6. According to an exemplary embodiment, the compensation ring 4 can be composed of a material which does not damage the soldered metal-ceramic junction between the cover 5 on the switching contact side of the vacuum interrupt chamber 1 and the ceramic 3, or the ceramic 3 itself. For example, the compensation ring 4 can be constituted by relatively soft metals such as aluminum, an aluminum alloy, copper or a copper alloy. In accordance with another exemplary embodiment, the compensation ring 4 can be constituted by plastic materials as well, where such plastic materials are temperature and pressure-resistant to injection-molding temperatures and injection-molding pressures during the injection-molding process. It is advantageous for the ring and the pole part, which can be produced by injection molding, for example, to be composed of the same material, or at least compatible materials (in this context, the term "compatible" means that the parts adhere to one another). The exemplary compensation ring 4 can then remain in the pole part after the injection-molding process. According to an exemplary embodiment, the mold core 6 which is used in the production process can be composed of hardened steel. The exemplary compensation ring 4 achieves a desired load reduction, such as when using the compensation ring 4 between the ceramic 3 of the vacuum interrupt chamber on the switching contact side, and a mold core 6 constituted by the hardened steel.

In the exemplary embodiment illustrated in FIGS. 1 and 2, a pole part of a medium switching device can be produced, in which a vacuum interrupt chamber 1 is provided with an insulating encapsulation. For example, the vacuum interrupt chamber 1 can be encapsulated together with a mold core 6, which is fitted to the vacuum interrupt chamber 1 on its lower cover, in a casting mold using an insulating material. According to the exemplary embodiment, before the encapsulation process, a compensation ring 4 is positioned as a separate injection-molded seal on or close to an external circumferential line of the vacuum interrupt chamber cover 5, between the lower cover of the vacuum interrupt chamber 1 and the mold core 6. The positioned compensation ring 4 is then encapsulated such that it remains as a lost seal in the encapsulation (i.e., it remains as positioned after the encapsulation process is completed), and then the mold core 6 is removed. According to the exemplary embodiment, a pole part for a medium-voltage switching device is provided, in which a vacuum interrupt chamber is provided with insulation encapsulation. As illustrated in FIGS. 1 and 2, the exemplary pole part includes a compensation ring 4 arranged for temporary contact with the injection-mold core 6 on a cover face of the vacuum interrupt chamber to which the injection-mold core 6 is temporarily applied for the encapsulation process. The compensation ring 4 is thus arranged so that it remains in the completed encapsulation.

An advantageous aspect of the exemplary embodiment can be summarized as follows:

The cover of the vacuum interrupt chamber is completely surrounded by the mold core 6 and is not loaded during the injection process. As a result, there is accordingly no need to reinforce the cover on the switching contact side. Accordingly, the cover of the vacuum interrupt chamber may therefore only need to be appropriately reinforced on the fixed contact side.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SYMBOLS

1 Vacuum interrupt chamber
2 Injection-molded plastic material
3 Ceramic of the vacuum interrupt chamber on the switching contact side
4 Compensation ring
5 Cover on the switching contact side of the vacuum interrupt chamber
6 Mold core

What is claimed is:

1. A method for production of a pole part of a medium-voltage switching device, in which a vacuum interrupt chamber is provided with an insulating encapsulation by which the vacuum interrupt chamber is encapsulated together with a mold core having an annular portion, which is fitted to the vacuum interrupt chamber on a lower cover of the vacuum interrupt chamber, in a casting mold using an insulating material, the method comprising:

before the encapsulation process, positioning a compensation ring as a separate injection-molded seal on or close to an external circumferential line of a vacuum interrupt chamber cover of the vacuum interrupt chamber, between the lower cover of the vacuum interrupt chamber and the mold core, the compensation ring contacting the annular portion of the mold core;

encapsulating the vacuum interrupt chamber so that the positioned compensation ring remains in the encapsulation; and removing the mold core.

2. The method as claimed in claim 1, wherein the mold core that is used in the production process is composed of hardened steel.

3. The method as claimed in claim 2, wherein the compensating ring which is used as the injection molded seal in the production process is composed of copper or a copper alloy.

4. The method as claimed in claim 2, wherein the compensating ring which is used as the injection-molded seal in the production process is composed of aluminum or an aluminum alloy.

5. The method as claimed in claim 1, wherein the compensating ring which is used as the injection molded seal in the production process is composed of copper or a copper alloy.

6. The method as claimed in claim 1, wherein the compensating ring which is used as the injection-molded seal in the production process is composed of aluminum or an aluminum alloy.

7. The method as claimed in claim 1, wherein the compensation ring which is used as the injection-molded seal in the production process is composed of temperature-resistant and pressure-resistant plastic.

8. The method as claimed in claim 7, wherein the temperature-resistant and pressure-resistant plastic is configured to withstand injection-molding temperatures and injection-molding pressures.

9. The method as claimed in claim 1, wherein the compensation ring is positioned between a circumference of the vacuum interrupt chamber and the vacuum interrupt chamber cover on a switching contact side of the vacuum interrupt chamber.

10. The method as claimed in claim 1, wherein the compensation ring is positioned to abut a stepped portion arranged on a wall of the vacuum interrupt chamber.

11. A pole part for a medium-voltage switching device, in which a vacuum interrupt chamber is provided with insulation encapsulation, the pole part comprising:

a compensation ring arranged for temporary contact with an injection-mold core on a cover face of the vacuum interrupt chamber to which the injection-mold core is temporarily applied for the encapsulation process, wherein the compensation ring is arranged to remain in the complete encapsulation, wherein the compensation ring is positioned to abut a stepped portion arranged on a wall of the vacuum interrupt chamber.

12. The pole part as claimed in claim 11, wherein the compensation ring is composed of copper or a copper alloy.

13. The pole part as claimed in claim 11, wherein the compensation ring is composed of aluminum or an aluminum alloy.

14. The pole part as claimed in claim 11, wherein the compensation ring is composed of temperature-resistant and pressure-resistance plastic.

15. The pole part as claimed in claim 14, wherein the temperature-resistant and pressure-resistant plastic is configured to withstand injection-molding temperatures and injection-molding pressures.

16. The pole part as claimed in claim 11, wherein the arranged compensation ring enables a cover of the vacuum interrupt chamber to be completely surrounded by the injection-mold core and not loaded during the injection process.

17. The pole part as claimed in claim 11, wherein the compensation ring is positioned between the vacuum interrupt chamber and a cover of the vacuum interrupt chamber on a switching contact side of the vacuum interrupt chamber.

* * * * *